United States Patent [19]

Saitou et al.

[11] Patent Number: 4,726,739

[45] Date of Patent: Feb. 23, 1988

[54] MULTIPLE CYLINDER ROTARY COMPRESSOR

[75] Inventors: Jisuke Saitou, Ashikaga; Kouichiro Kubota, Ota; Hidetaka Sasaki; Yasunori Kiyokawa, both of Oizumi; Masayuki Hara, Tatebayashi; Makoto Aida, Oizumi, all of Japan

[73] Assignee: Sanyo Electric Co., Ltd., Osaka, Japan

[21] Appl. No.: 909,114

[22] Filed: Sep. 18, 1986

[30] Foreign Application Priority Data

Sep. 20, 1985 [JP] Japan ..... 60-209385

[51] Int. Cl.[4] ..... F04C 29/08

[52] U.S. Cl. ..... 417/286; 417/310; 418/212

[58] Field of Search ..... 417/285, 286, 310; 418/212

[56] References Cited

U.S. PATENT DOCUMENTS

| | | | |
|---|---|---|---|
| 2,034,159 | 3/1936 | Swartwout | 417/285 X |
| 2,125,355 | 8/1938 | Metzger | 417/285 X |
| 2,454,563 | 11/1948 | Mercier | 417/285 X |
| 2,550,457 | 4/1951 | Dodson | 417/286 |
| 2,683,417 | 7/1954 | Burton | 417/285 |
| 4,452,571 | 6/1984 | Koda et al. | 417/286 |
| 4,505,122 | 3/1985 | Inomata | 417/286 X |
| 4,636,148 | 1/1987 | Takeo et al. | 417/286 |

FOREIGN PATENT DOCUMENTS

| | | | |
|---|---|---|---|
| 46-5964 | 3/1971 | Japan . | |
| 55-15009 | 4/1980 | Japan . | |
| 60-53692 | 3/1985 | Japan | 417/286 |

*Primary Examiner*—Leonard E. Smith
*Assistant Examiner*—Theodore Olds
*Attorney, Agent, or Firm*—Wenderoth, Lind & Ponack

[57] ABSTRACT

A multiple cylinder rotary compressor according to the present invention comprises a driving shaft, cylinders concentric to the driving shaft, rotors driven by eccentric portions of the rotary shaft to rotate along the inner circumferential surface of the cylinders, vanes for dividing each of the cylinders into a compression side and a suction side, a partition plate for separating the cylinders from each other, and a control through-hole for connecting the cylinders with each other so that a refrigeration capacity is controlled.

4 Claims, 18 Drawing Figures

MULTIPLE CYLINDER ROTARY COMPRESSOR

BACKGROUND OF THE INVENTION

The present invention relates to a multiple cylinder rotary compressor and more particularly to a hermetically sealed multiple cylinder compressor including new and improved means for controlling refrigeration capacity.

Heretofore, such an apparatus as shown in FIG. 17 has been proposed by, for example, Japanese Utility Model Publication No. 46-5964, published Mar. 3, 1971 as a single cylinder type rotary compressor. In FIG. 17, a rotary compressor 1 has a cylinder block 4 having a cylinder 3 concentric to a driving shaft 2, a rotor 6 rotated along an inner circumferential surface of the cylinder 3, a vane 10 which is pressed against an outer surface of the rotor 6 by a coil spring 7 to divide the cylinder 3 into a suction side 8 and a compression side 9 and suction opening 11 located at one side of the vane 10 to connect with the suction side 8 and a discharge opening 12 which is provided at the other side of the vane 10. The suction opening 11 is connected to a suction pipe 13. The compression side 9 is connected through the discharge opening 12 to a discharge port or muffler 14, which is formed in the cylinder block 4 and has a discharge valve 15 to open and close the discharge opening 12. The cylinder block 4 has a gas-release slot 16 at a portion distal to the suction opening 11 so that the cylinder 3 is communicated to the suction side, which is communicated to the suction opening 11, by the gas-release slot 16. In the conventional rotary compressor described above, when a gas flown from the suction opening 11 to the suction side 8 is compressed by rotation of the rotor 6 in an initial compression stroke, the gas is partly released out of the gas-release slot 16 to cause a delay of compression, so that a refrigeration capacity is controlled.

However, the above-described conventional rotary compressor has disadvantages as described hereinbelow. Namely, the gas flown from the suction opening 11 into the cylinder 3 is partly discharged out of the cylinder 3 and, accordingly, a suitable shielding device must be used so that the gas-release slot 16 is not connected to the discharge muffler 14, and therefore the structure becomes complex. Further, in case of a multiple cylinder rotary compressor, a plurality of gas-release slots must be formed for the cylinders and, accordingly, manufacturing and assembling steps become complex.

Japanese Utility Model Publication No. 55-15009, published Apr. 7, 1980, shows another rotary compressor as illustrated in FIG. 18, which is somewhat similar to the first-mentioned conventional rotary compressor shown in FIG. 17. For example, rotary compressor 1 has a rotor 6, suction side 8, pressure side 9, vane 10, and discharge valve 15. Various differences are described hereinbelow. In the structure of FIG. 18, a controller 19 is disposed on the cylinder block 4 at the portion opposite to the position of discharge opening 12. The controller 19 has a guide hole 20 at the cylinder wall, and a capacity controlling valve 21 in a controlling chamber 22 to open and close the guide hole 20. The controlling chamber 22 is connected to a controlling tube 23, which is selectively connected to an outlet of a condenser 25 and a suction tube 13 of an outlet of an evaporator 26, by means of a three-way valve 24. In FIG. 18, reference numeral 27 is a capillary tube connected between the condenser 25 and the evaporator 26. In this conventional rotary compressor, the capacity controlling valve 21 is controlled by either a high-pressure refrigerant from the outlet of the condenser 25 or a low-pressure refrigerant from the outlet of the evaporator 26 by means of the three-way valve 24, and a refrigeration capacity of the rotary compressor 1 is controlled by the operation of the capacity controlling valve 21.

Further, in this second conventional rotary compressor, the low-pressure refrigerant is effected on the controlling chamber 22 by the three-way valve to thereby open the capacity controlling valve 21, and the refrigerant flown from the suction opening 11 into the cylinder 3 is partly returned from the controlling tube 23 to the suction tube 13. Therefore, a pulsating refrigerant is flown through the controlling tube 23, generating vibration and/or noise, and a relatively large-diameter tube must be installed for returning the refrigerant.

SUMMARY OF THE INVENTION

An object of the present invention is to provide an improved multiple cylinder rotary compressor which permits controlling of a refrigeration capacity thereof.

Another object of the present invention is to provide a new multiple cylinder rotary compressor of a simple structure.

A further object of the present invention is to provide a new multiple cylinder rotary compressor generating less vibration and noise.

Briefly, the multiple cylinder rotary compressor according to the present invention comprises a driving shaft, superposed cylinder blocks relating to the driving shaft, rotors driven by eccentric portions of the driving shaft to rotate along inner circumferential surface of the cylinders, vanes for dividing each of the cylinders into a compression side and a suction side, a partition plate for separating the cylinders from each other, and a control through-hole for connecting the cylinders with each other. Preferably, the control through-hole is disposed in the partition plate, but may be formed by combination of a through-hole of the partition plate and grooves additionally formed on an inner wall of the cylinders.

In another preferred embodiment of the invention, a valve device is disposed in the through-hole to open and close the through-hole so that the gas in one compression chamber is partly released into other cylinder.

BRIEF DESCRIPTION OF THE DRAWINGS

FIGS. 13 through 16 show another embodiment of the present invention, wherein:

FIG. 13 is a diagram illustrating a refrigeration circuit;

FIG. 14 is a sectional elevation of a two-cylinder rotary compressor according to another embodiment of the present invention;

FIG. 15 is, as similar as FIG. 2, a sectional view taken along line XV—XV of FIG. 14, and simplified for the purpose of clarification;

FIG. 16 is an enlarged sectional view of a valve device and its periphery of the compressor shown in FIG. 14.

PREFERRED EMBODIMENTS OF THE INVENTION

Figure 1:
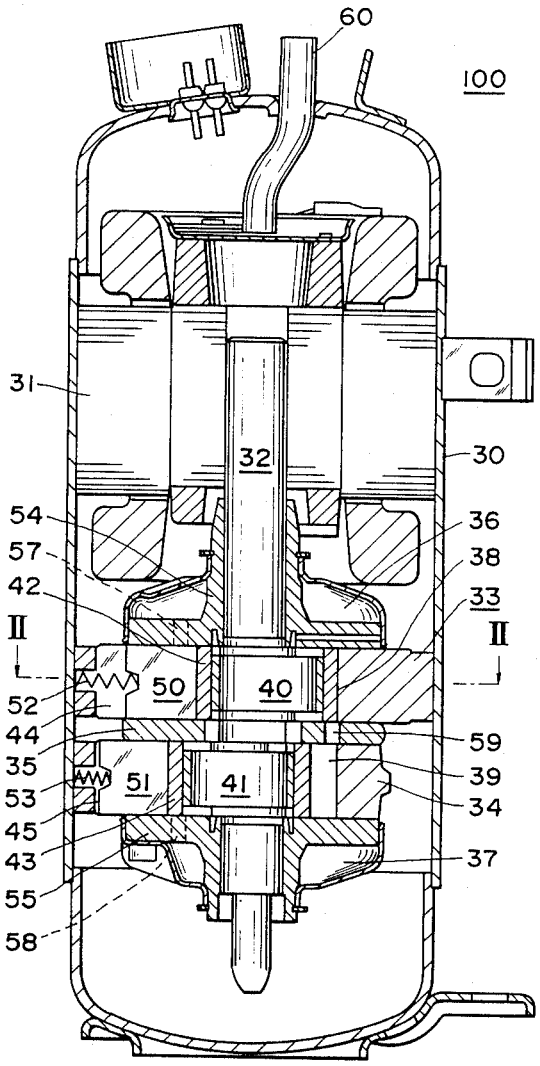
FIG. 1 is a sectional elevation of a two-cylinder rotary compressor embodying the present invention.
Figure 2:
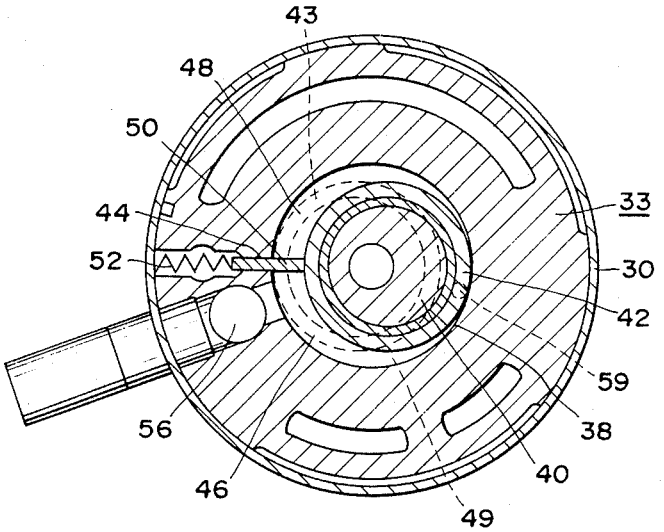
FIG. 2 is a sectional view taken along line II—II of FIG. 1, but simplified for the purpose of clarification.

Referring first to FIGS. 1 and 2, a multiple cylinder rotary compressor, which is generally indicated at 100, has a shell or hermetically sealed casing 30 within which an electric motor 31 is located at an upper portion and two rotary cylinder blocks 33, 34, driven by a driving shaft 32 of the electric motor 31, are located at a lower portion. The upper and lower cylinder blocks 33, 34 have cylinders 38, 39, respectively, which are concentric to the driving shaft 32, and constitute two rotary compressor elements with a partition plate 35. Further, the rotary compressor elements have eccentric portions 40, 41 mounted to the driving shaft 32 and having difference of rotary angle of 180 degrees to each other. The rotary compressor elements also have rotors 42, 43 rotated along an inner circumferential surface of the cylinders 38, 39, vanes 50, 51 which slide along guide grooves 44, 45, respectively, and contact the rotors 42, 43 to divide the cylinders 38, 39 into a suction side 46 and a compression side 48 (in the upper cylinder 38), and into a suction side 47 and a compression side 49 (in the lower cylinder 39). Coil springs 52, 53 are disposed on one side of the vanes 50, 51, respectively. The cylinder blocks 33, 34 have an upper bearing 54 and a lower bearing 55 for closing openings of the cylinders. Reference numeral 56 (FIG. 2) represents a suction passage which is bifurcated and open to the suction side 46, 47 of the cylinders 38, 39. The upper and lower bearings 54, 55 have discharge passages 57, 58 which are selectively opened to the compression sides 48, 49 of the cylinders 38, 39. The partition plate 35 has a through-hole 59 which is spaced from the suction passage 56 and functions to connect the upper cylinder 38 with the lower cylinder 39. The casing 30 has a discharge tube 60 at its upper end portion for discharging a high pressure gas.

The operation of the two cylinder rotary compressor shown in FIGS. 1 and 2 will be explained with reference to FIGS. 3-10. A refrigerant introduced from the suction passage 56 (FIG. 2) into the cylinders 38, 39 of the cylinder blocks 33, 34 is compressed by the combination of rotors 42, 43 and vanes 50, 51 and then discharged from the discharge passages 57, 58 to a space within the casing 30 through discharge mufflers 36, 37. Then, the refrigerant is discharged out of the hermetic casing 30 through the electric motor 31.

Figure 6:
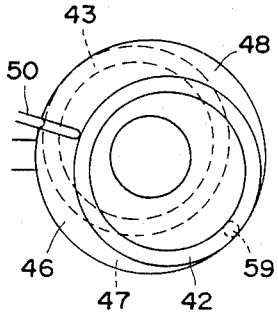
Figure 7:
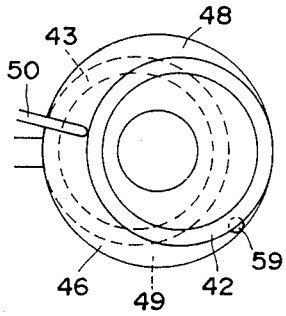
Figure 8:
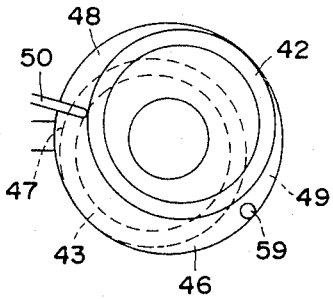
Figure 9:
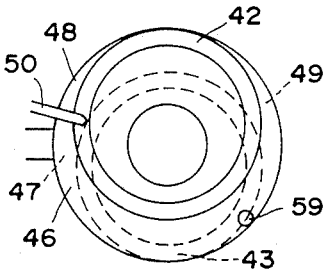
Figure 10:
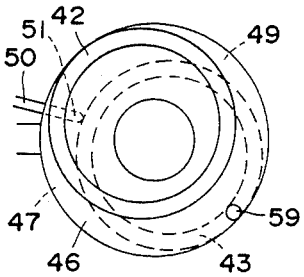

The rotors 42, 43 are rotated with a rotational angular deviation of 180 degrees to each other, and compress the refrigerant within the cylinders 38, 39. When the upper rotor 42 is placed into a compression stage at a rotational angle of 0 degree (FIG. 3) relative to the position of sliding vanes 50 as a reference point, the lower rotor 43 is subject to compression and suction strokes at a rotational angle of 180 degrees relative to a position of the sliding vanes 51. Therefore, the through-hole 59 of the partition plate 35 is opened to both the compression side 48 of the upper cylinder 38 and the suction side 47 of the lower cylinder 39, and the refrigerant in the compression side 48 is released into the suction side 47 (FIGS. 4 and 5) so that the compression stroke is delayed until the rotor 42 in the upper cylinder 38 passes the through-hole 59 (FIG. 6). Thus the location of the through-hole causes the delay of the compression stroke and determines the amount of refrigerant which is discharged out of the discharge passage 57 and the refrigeration capacity of the upper rotary compressor element 33. Similarly, when the upper rotor 42 is positioned at a 180 degree rotary angle relative to the sliding vane 50 while the lower rotor 43 is at 0 degree rotary angle with the sliding vane 51, the refrigerant in the compression side 49 of the lower cylinder 39 is released through the through-hole 59 to the suction side 46 of the upper cylinder 38 to control refrigeration capacity of the lower rotary compressor element 34 (FIGS. 7-10).

Since the through-hole 59 is formed in the partition plate 35 so as to obtain a desired compressor capacity, refrigerant within the upper cylinder 38 can be released to the lower cylinder 39 and vice versa by means of a single through-hole.

In a case that the through-hole 59 is located in the opposite position relative to the sliding vanes 50, 51; that is, a rotational angle of 180 degrees, the refrigerant in the compression stroke is released into the low-pressure sides 46, 47 of the cylinders.

Figure 11:
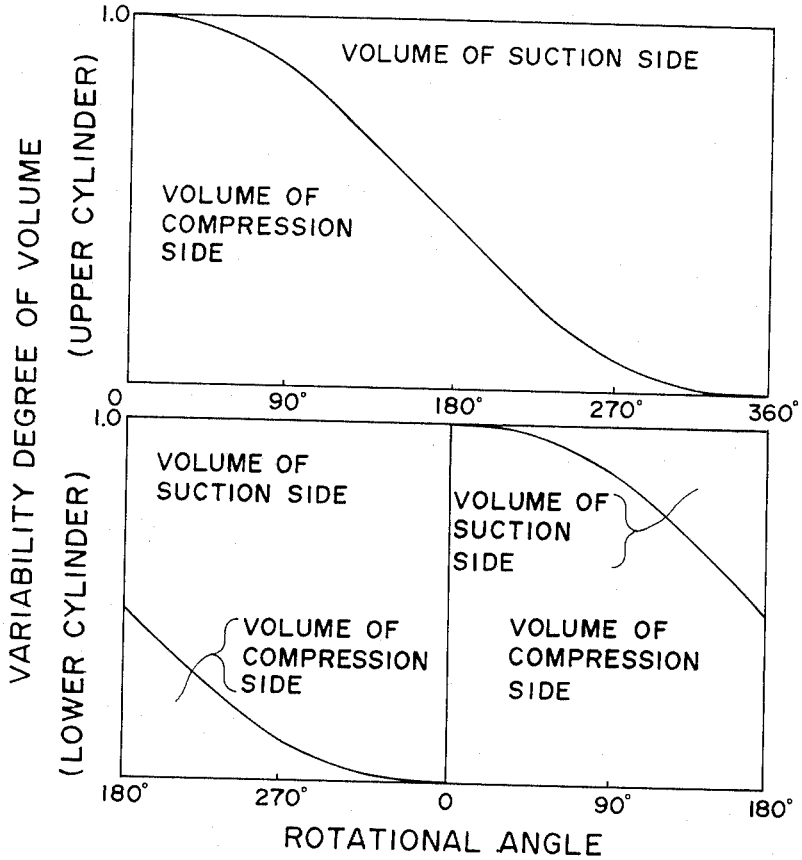
FIG. 11 is the diagram showing a volume change as a function of the rotational angle of the upper and lower cylinders of the two-cylinder rotary compressor of FIG. 1.

On the other hand, in a case that the through-hole 59 is located in the range of rotational angles over 180 degrees, the cylinders 38, 39 are connected together even in the compression stroke of the both cylinders and the refrigerant is commonly compressed. However, as illustrated in FIG. 11, there is a difference in a volume change per a rotational angle between the upper cylinder 38 and the lower cylinder 39. For example, with respect to a compressor in which a compression stroke of the rotor 42 of the cylinder 38 advances for a rotary angle of 180 degrees, and when the upper and lower cylinders are connected together by the through-hole 59, a volume change of the upper cylinder 38 is larger than that of the lower cylinder 39, accordingly, a pressure in the upper cylinder becomes higher than that in the lower cylinder. Thus, the refrigerant in the upper cylinder 38 is released through the through-hole 59 into the lower cylinder 39 to control the refrigeration capacity. On the other hand, the refrigerant in the lower cylinder 39 flows into the suction side 46 of the upper cylinder 38 when the suction side 46 is positioned at the through-hole 59, and the amount of refrigerant which is compressed in the lower cylinder is decreased to obtain a low capacity operator.

Figure 12:
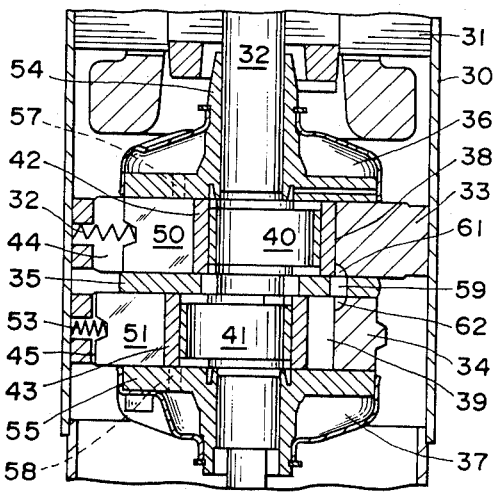
FIG. 12 is a sectional view of a slight modification of the two-cylinder rotary compressor of FIG. 1.
Figure 14:
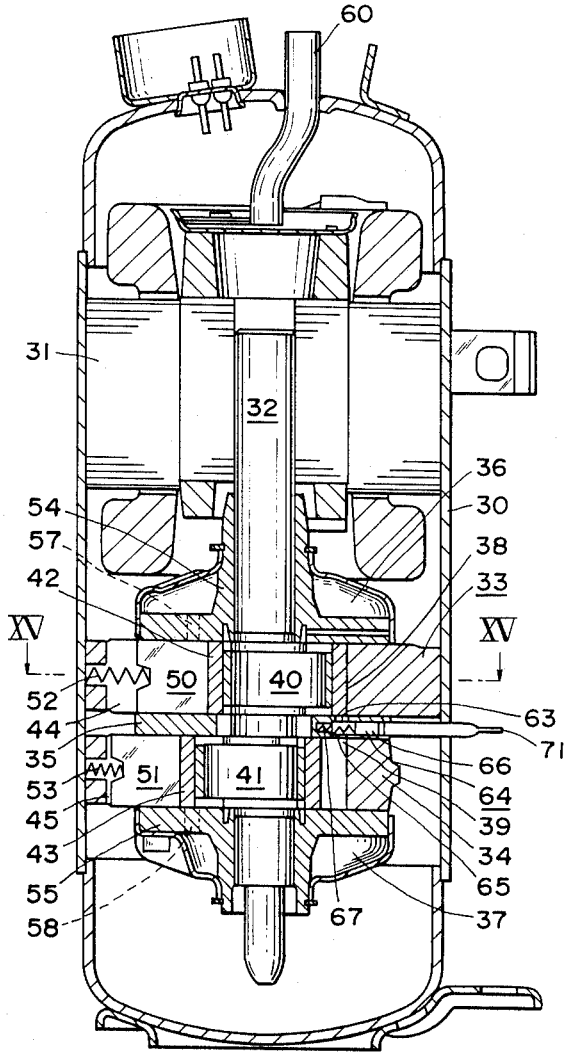
Figure 15:
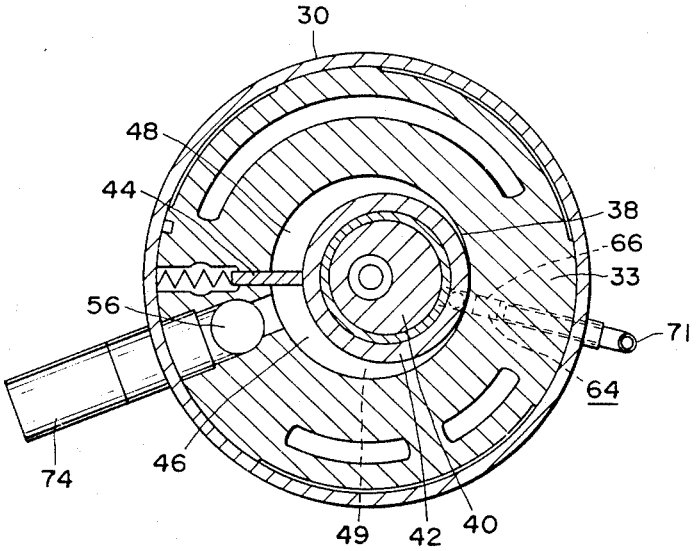
Figure 16:
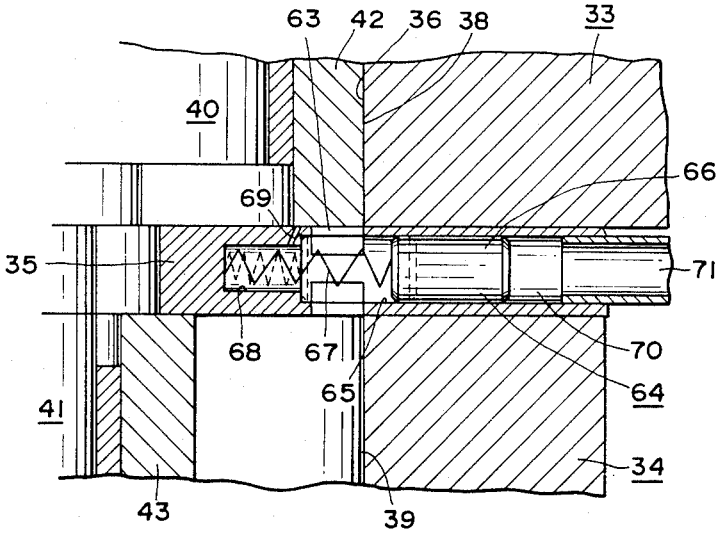
Figure 17:
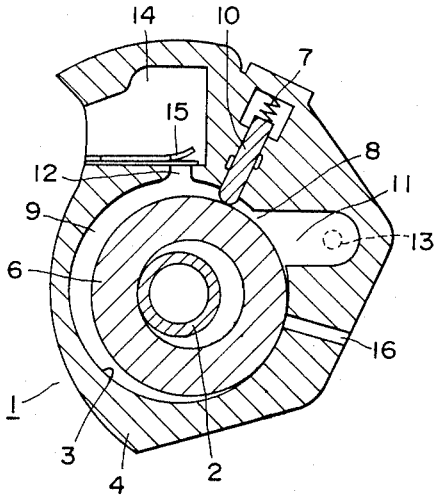
FIG. 17 (PRIOR ART)
FIGS. 17 and 18 show the conventional rotary compressors, which have been discussed hereinabove.
Figure 18:
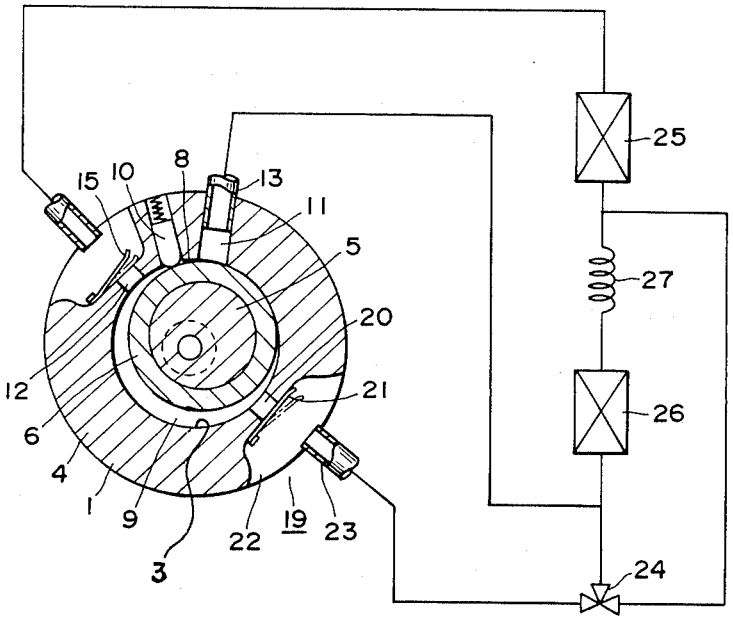
FIG. 18 (PRIOR ART)

FIG. 12 shows a modification in which recesses 61, 62 are formed on the circumferential inner surface of the upper and lower cylinders 38, 39, respectively so that the refrigerant in the cylinders is released through the combination of the recesses 61, 62 and the through-hole 59.

In the embodiment which has been described above, a refrigeration capacity of the rotary compressor can be controlled readily by merely forming a through-hole in the partition plate. Further, the refrigerant in one of the upper and lower cylinders is released to the other end, accordingly, it is not necessary to provide a gas-releasing portion in each of the cylinder blocks.

Figure 13:
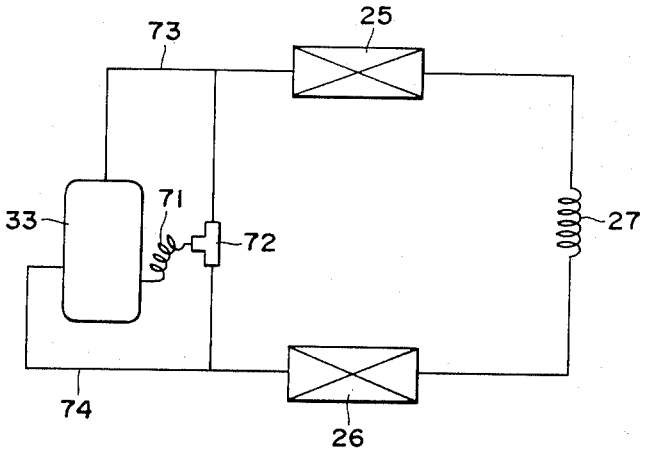
Figure 3:
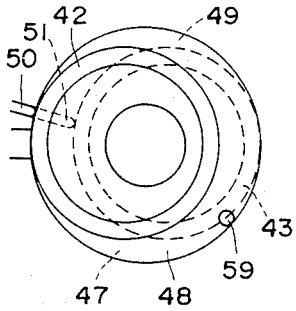
FIGS. 3 through 10 are diagrams illustrating operation of the rotors of the rotary compressor of FIG. 1.
Figure 4:
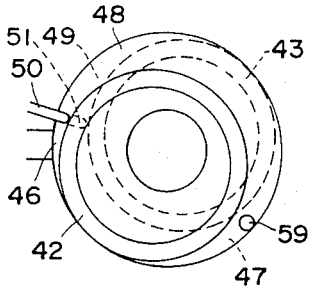
Figure 5:
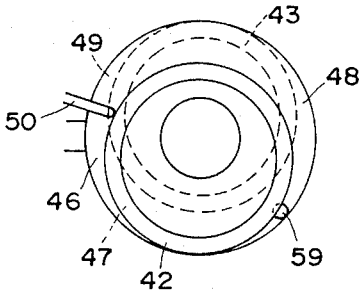

FIGS. 13 through 16 show another embodiment of the present invention, in which the partition plate 35 has a through-hole 63 which is as similar as the through-hole 59 of the first embodiment and is located slightly apart from the suction hole 56 in the rotational direction to connect a compression side 48 of an upper cylinder 38 with a compression side 49 of a lower cylinder 39. The through-hole 63 has a valve device 64 for opening and closing it. The valve device 64 has a slot 65 which extends at a right angle with the through-hole 63, a plunger 66 reciprocating in the slot 65, a spring 67 for biasing the plunger 66 to open the through-hole 63, a spring housing 68, an aperture 69 for connecting the spring housing 68 with the compression side 48 of the upper cylinder, and a controlling chamber 70 for effecting a refrigerant pressure onto the plunger 66 at the opposite side of the spring 67. The controlling chamber 70 has a controlling tube 71 which is connected to one end of a three-way valve 72 (FIG. 13). The other two ends of the three-way valve 72 are connected to a discharge tube 73 and a suction tube 74 of a suction passage 56 of the rotary compressor elements 33, 34, respectively.

In the structure of the embodiment of FIGS. 13–16 refrigerant flown from the suction passage 56 into the cylinders 38, 39 is compressed by the combination of rotors 42, 43 and vanes 50, 51 and discharged from the discharge passages 57, 58 into a hermetically sealed casing 30. The refrigerant from the discharge tube 73 is then fed to the condenser 25 through a gap in the electric motor 31, and the refrigerant is then condensed and liquified. The liquid refrigerant is expanded by an expansion valve or capillary tube 27 and evaporated by an evaporator 26 and then returned to the rotary compressor from the suction tube 74. In this operational state, if the three-way valve 72 is opened to the discharge tube 73, high-pressure refrigerant which has been directed to the controlling chamber 70 acts upon the plunger 66 so that the through-hole 63 of the partition plate 35 is closed by the plunger 66. Thus, the refrigerant which has been introduced into the cylinders 38, 39 from the suction passage 56 is compressed and discharged out of the discharge passages 57, 58 and then a full load operation starts. If the three-way valve 72 is opened to the suction tube 74, the plunger 66 is pressed by a force of the spring 67 toward the controlling chamber 70 which has received low-pressure refrigerant from the controlling tube 71, and the through-hole 63 is opened. By this, the refrigerant flown from the suction passage 56 into the cylinders 38, 39 is released from one cylinder to the other alternately until the rotors 42, 43 close the through-hole 63, and the amount of the refrigerant discharged from the discharge passages 57, 58 is decreased so that a controlled operation of a small refrigerant capacity is obtained. Namely, in the embodiment of the valves shown in FIG. 16 the rotors 42, 43 which compress the refrigerant in the cylinders 38, 39 are rotated with a deviation of a rotary angle of 180 degrees, and when the upper cylinder is placed into a compression stroke with the upper rotor 42 being at 0 degrees of rotational angle relative to a position of the vanes 50 as a reference point, the lower rotor 43 provides a compression stroke and a suction stroke simultaneously at its rotational angle of 180 degrees relative to the position of the sliding vanes 51. Therefore, the through-hole 63 is opened to both a compression side of the upper cylinder 38 and a suction side of the lower cylinder 39, and the refrigerant in the compression side 48 is released to the suction side 47 so that the amount of refrigerant which is compressed in the upper cylinder is decreased to provide a low capacity operation. Similarly, when the upper rotor 42 is positioned at a rotational angle of 180 degrees and the lower rotor 43 is at a rotational angle of 0 degree, the refrigerant in the compression side of the lower cylinder 39 is released through the through-hole 63 to the suction side so that a low capacity operation of the lower rotary compressor element 34 is obtained.

At this motion of the rotors, the through-hole 63 which is opened and closed by the valve device 64 functions to release the refrigerant in the upper cylinder 38 to the lower cylinder 39, and vice versa so that there is no refrigerant flow to the controlling tube 71. Thus, in a low-capacity operation, the controlling tube 71 is free from being vibrated owing to pulsation of the released refrigerant.

If the plunger 66 is not moved by a spring force of the spring 67 even when the three-way valve 72 is switched over from the discharge tube 73 to the suction tube 74, the aperture 69 which connects the spring chamber 68 with the upper cylinder 38 functions to forcibly move the plunger 66 toward the controlling chamber 70 to open the through-hole 63 by acting the compressed refrigerant onto the spring chamber 68.

In another embodiment, the valve device which is actuated by the refrigerant in the embodiment described above may be constructed as an electrically operated solenoid valve, not illustrated. The valve device permits an easy control of refrigeration capacity of the rotary compressor.

While the invention has been described with respect to preferred embodiments, it should be apparent to those skilled in the art that various changes and modifications may be made in the invention without departing from the spirit and scope thereof.

What is claimed is:

1. A multiple cylinder rotary compressor comprising:

(a) a driving shaft rotatable by means of a driving device and having eccentric portions thereon;

(b) superposed cylinder blocks having cylinders therein concentric to said driving shaft;

(c) rotors attached to and driven by said eccentric portions of said driving shaft to rotate along the inner circumferential surface of said cylinders, adjacent ones of said eccentric portions of said driving shaft being rotatively offset by 180 degrees relative to each other;

(d) sliding vanes slidably received in respective cylinder blocks and pressed against an outer surface of said rotors by a coil spring to divide each of said cylinders into a suction side and a compression side, said suction side of each of said cylinders having a suction passage with said suction passage of one cylinder superposed to the suction passage of the other cylinder, said sliding vanes being positioned to have the same rotary angular phase relative to said suction passage;

(e) a partition plate for separating said superposed cylinder blocks from each other; and (f) said partition plate having a through-hole for connecting said compression side and said suction side of said cylinders with each other for controlling a refrigeration capacity.

2. A multiple rotary compressor according to claim 1, wherein said through-hole extends in a direction substantially parallel to the longitudinal direction of said driving shaft.

3. A multiple rotary compressor according to claim 2, wherein said through-hole has a valve device for selectively opening and closing said through-hole.

4. A multiple rotary compressor according to claim 3, wherein said valve device is an electrically operated solenoid valve.

* * * * *